United States Patent [19]

Lin et al.

[11] 4,092,811

[45] June 6, 1978

[54] COOLING TOWER, CONSTRUCTION METHOD THEREFOR AND PRECAST PRESTRESSED CONCRETE BUILDING UNITS

[75] Inventors: Tung-Yen Lin, El Cerrito; Yue-Chyou Yang, San Francisco, both of Calif.

[73] Assignee: T. Y. Lin International, San Francisco, Calif.

[21] Appl. No.: 768,175

[22] Filed: Feb. 14, 1977

[51] Int. Cl.[2] ..... E04H 12/16

[52] U.S. Cl. ..... 52/224; 52/80; 52/228; 52/244; 52/248; 261/DIG. 11

[58] Field of Search ..... 261/DIG. 11; 52/227–229, 244, 245, 248, 80, 81, 224

[56] References Cited

U.S. PATENT DOCUMENTS

| | | | |
|---|---|---|---|
| 2,759,332 | 8/1956 | Lloyd | 52/227 |
| 3,300,942 | 1/1967 | Horstman | 52/80 |

FOREIGN PATENT DOCUMENTS

| | | | |
|---|---|---|---|
| 253,219 | 5/1963 | Australia | 52/228 |
| 224,319 | 11/1958 | Austria | 52/224 |
| 363,016 | 12/1931 | United Kingdom | 261/DIG. 11 |
| 797,413 | 7/1958 | United Kingdom | 261/DIG. 11 |
| 905,399 | 9/1962 | United Kingdom | 52/228 |

*Primary Examiner*—Ernest R. Purser
*Assistant Examiner*—Henry Raduazo
*Attorney, Agent, or Firm*—Owen, Wickersham & Erickson

[57] ABSTRACT

A large, thin-shell cooling tower, a method for its erection, and novel precast units. Upon a foundation a series of angularly-extending columns is erected, and the columns are joined at their upper ends by a lower ring. Then a ribbed, waffle-like reinforced concrete wall is constructed to extend up from the lower ring and to provide a shell with a shape such as a hyperbolic paraboloid. The ribbed outer (or inner) surface strengthens the structure while enabling the thickness of the portions in between the ribs to be relatively thin. A series of vertically-spaced horizontal circumferential reinforcing bars or post-tensioning cables and a series of horizontally-spaced vertical or inclined bars or cables, are included in the wall. The wall is preferably made up from a series of precast units that are of novel structure in themselves. At the top of the wall is an upper ring joining the various elements together.

11 Claims, 40 Drawing Figures

FIG.1
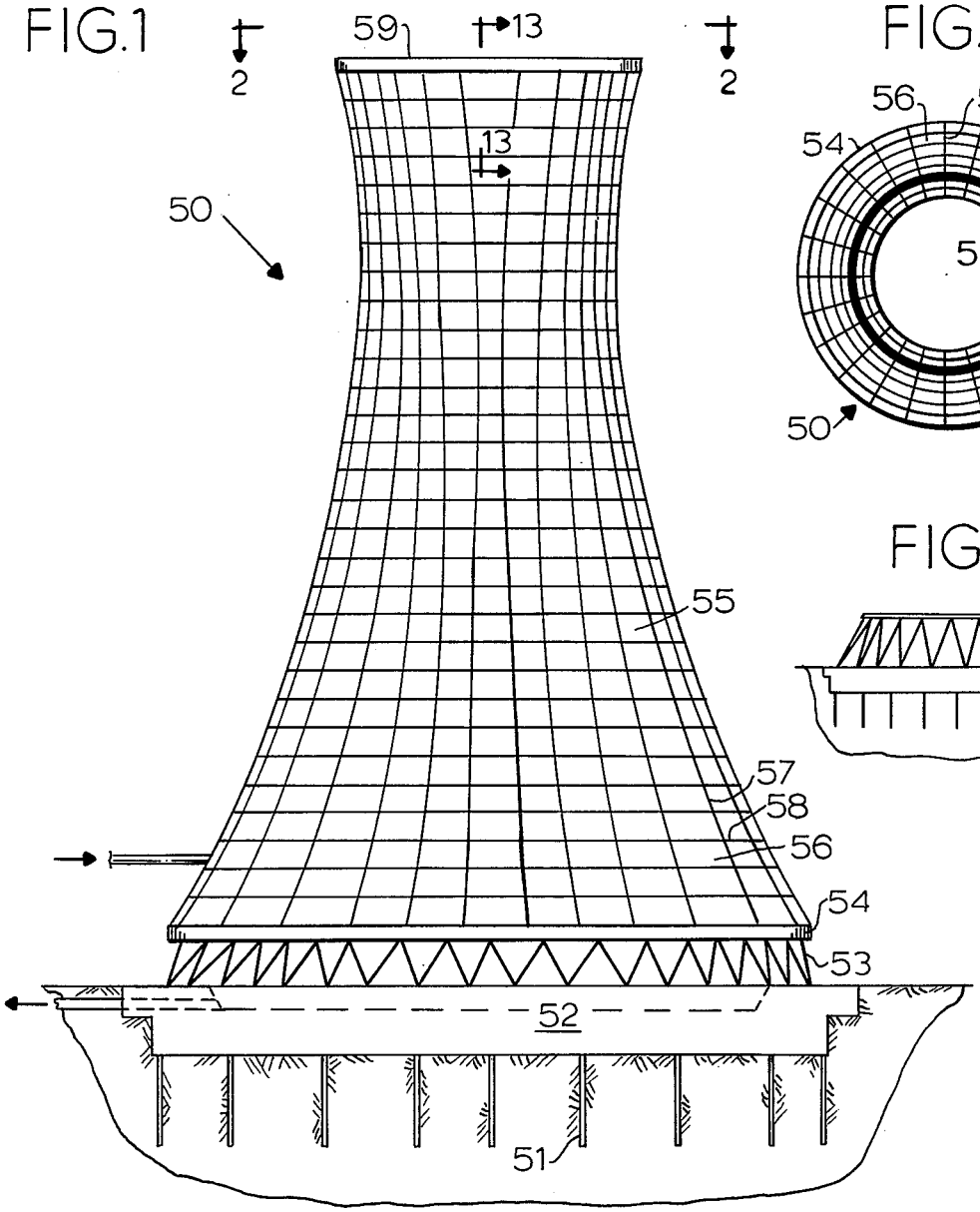
FIG. 2
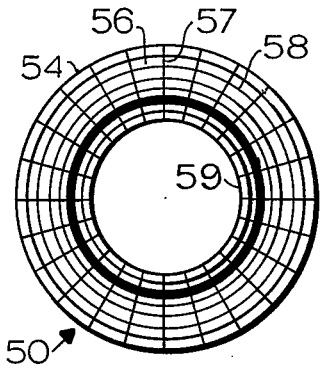
FIG. 3
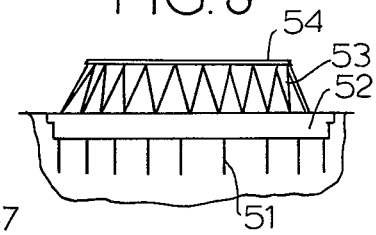
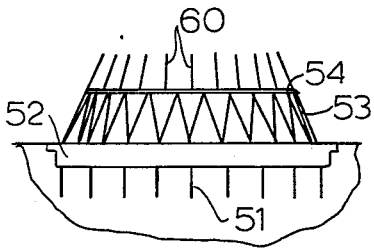
FIG.4
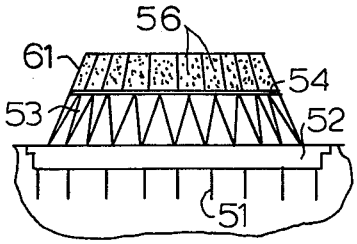
FIG. 5
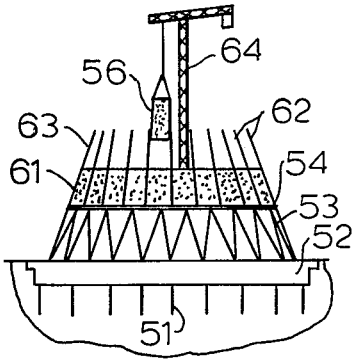
FIG. 6

FIG. 7
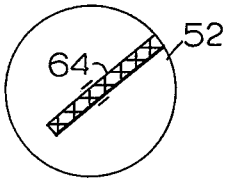
FIG. 8
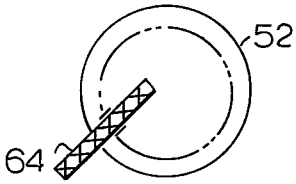
FIG. 9
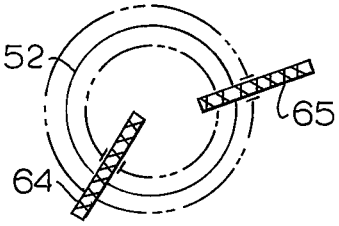
FIG. 10
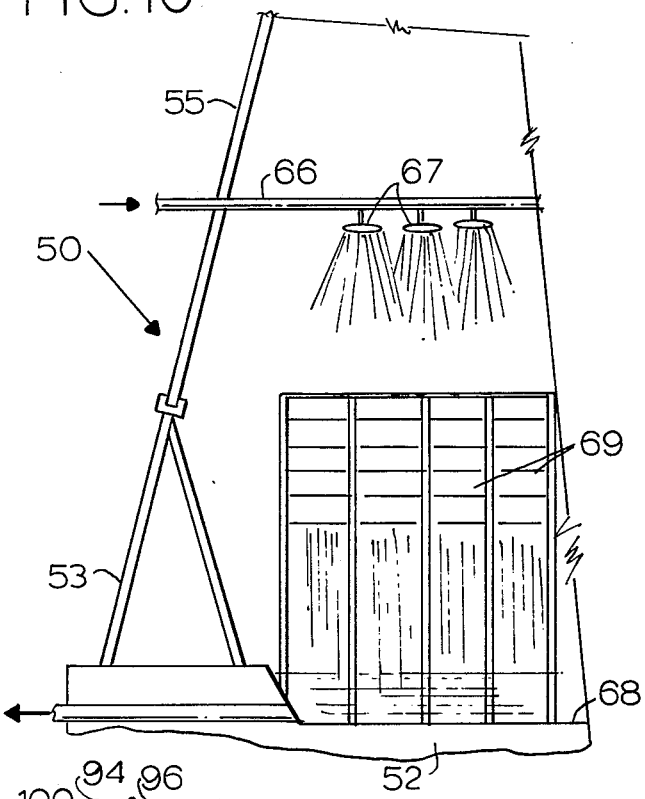
FIG. 11
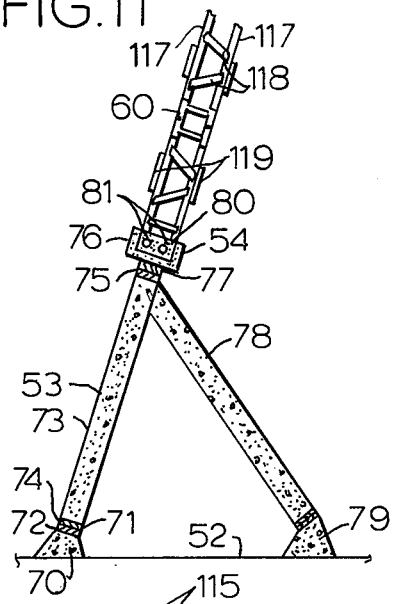
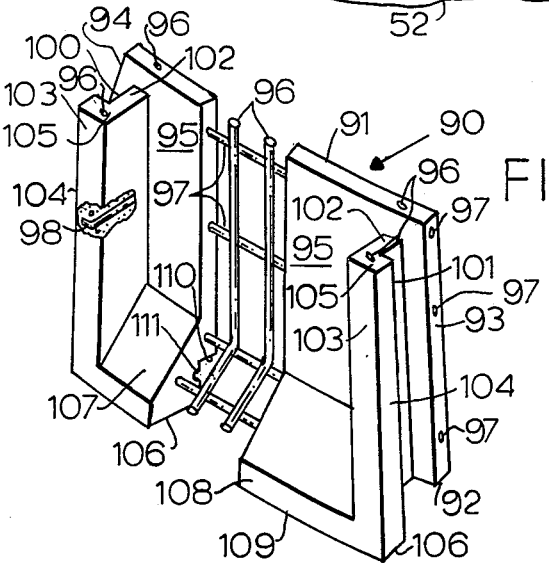
FIG. 12
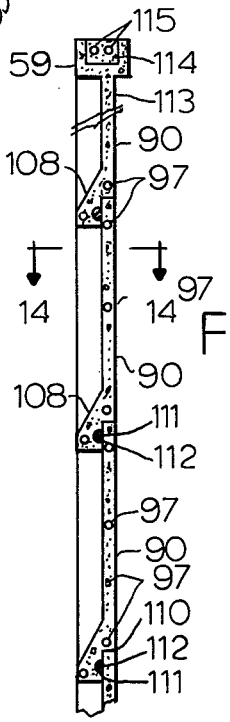
FIG. 13

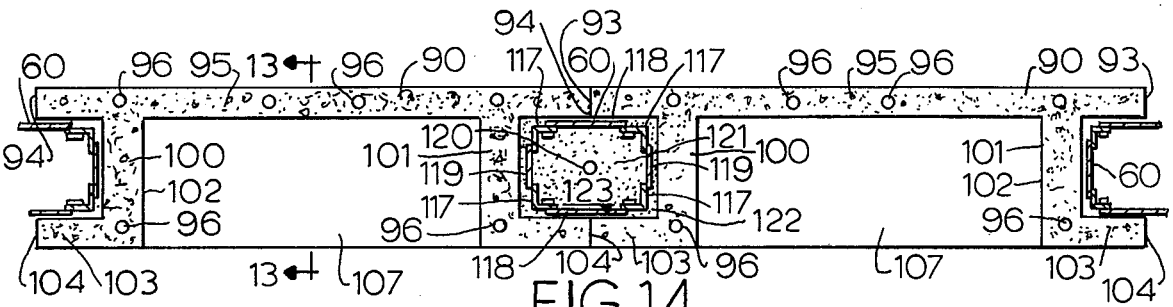
FIG. 14
FIG. 15
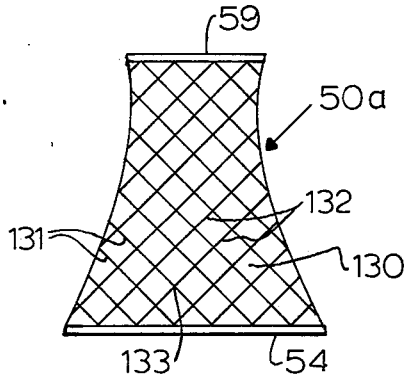
FIG. 17
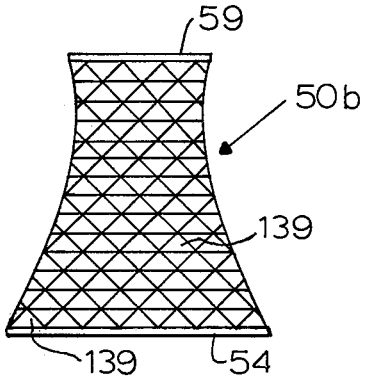
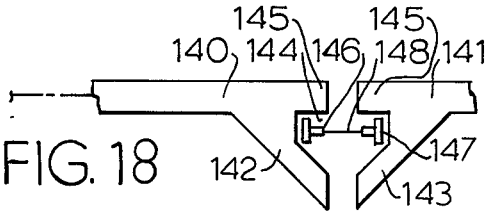
FIG. 18
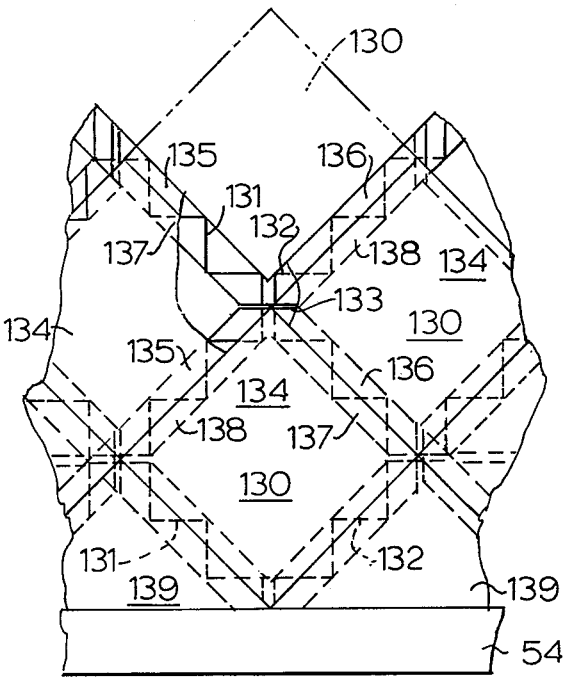
FIG. 16
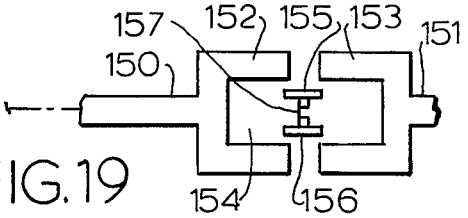
FIG. 19
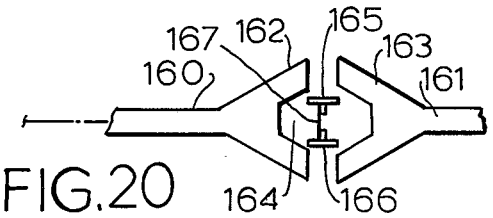
FIG. 20

FIG. 29
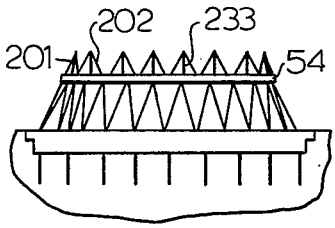
FIG. 31
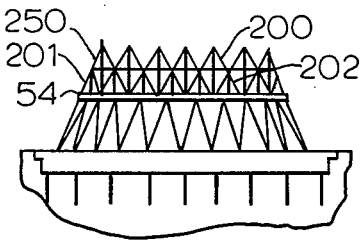
FIG. 33
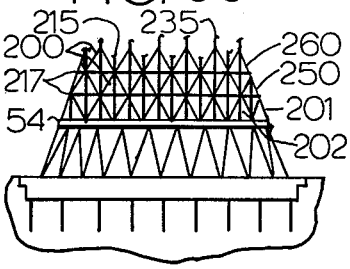
FIG. 30
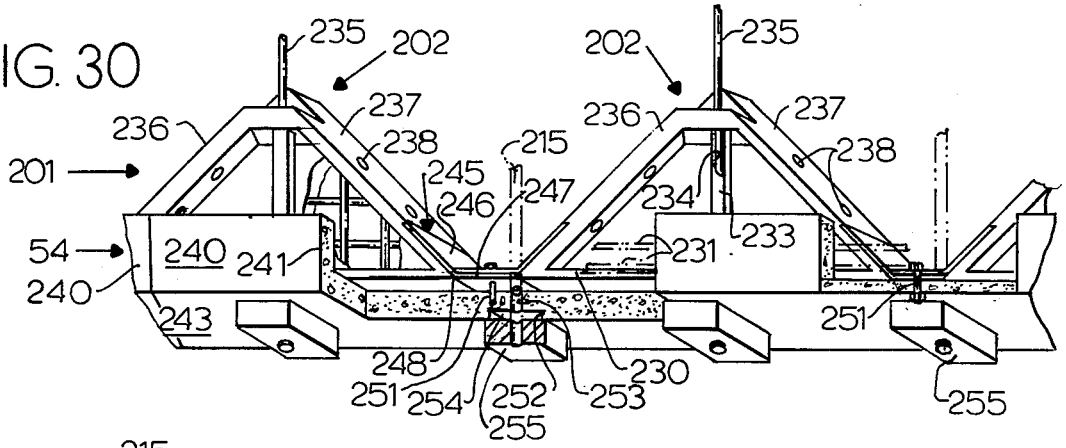
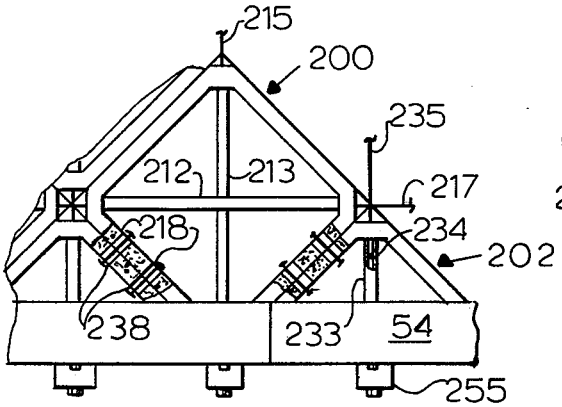
FIG 32
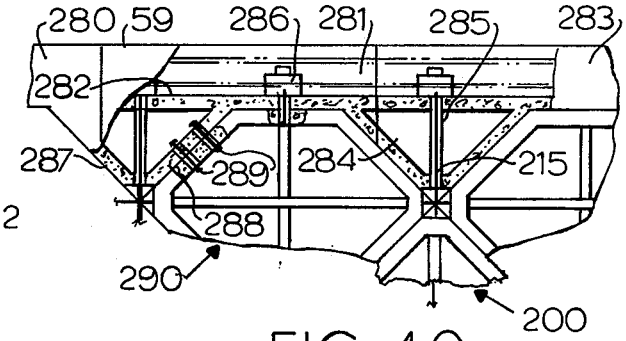
FIG. 40

FIG. 34
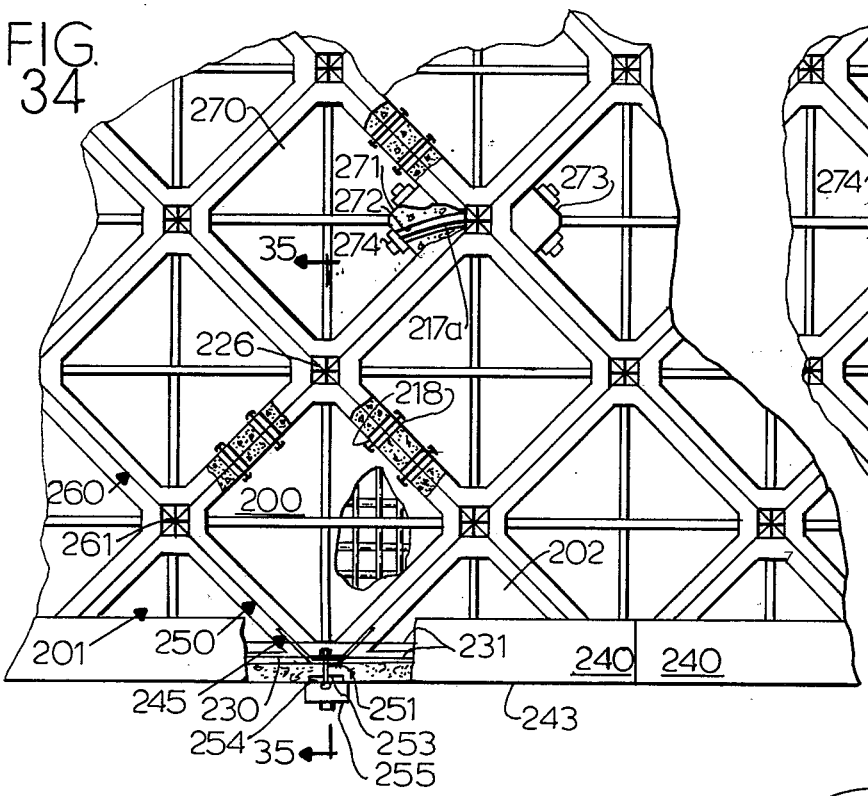
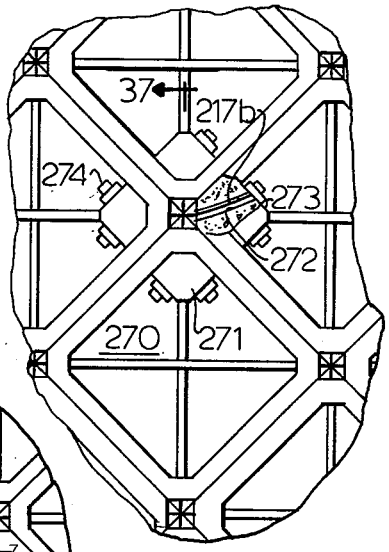
FIG. 36
FIG. 35
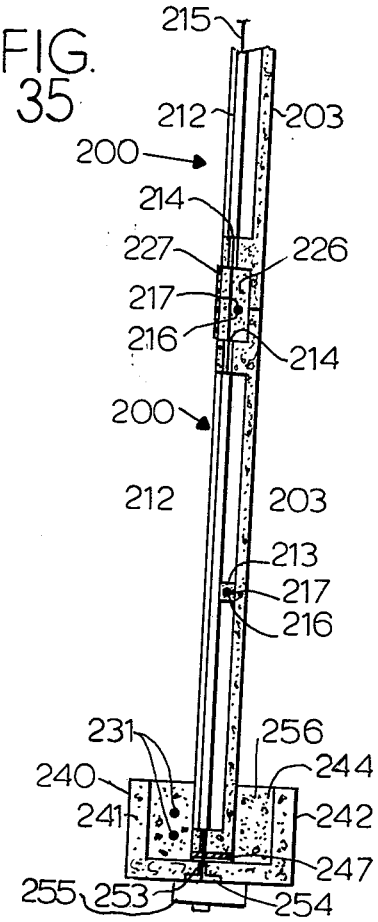
FIG. 37
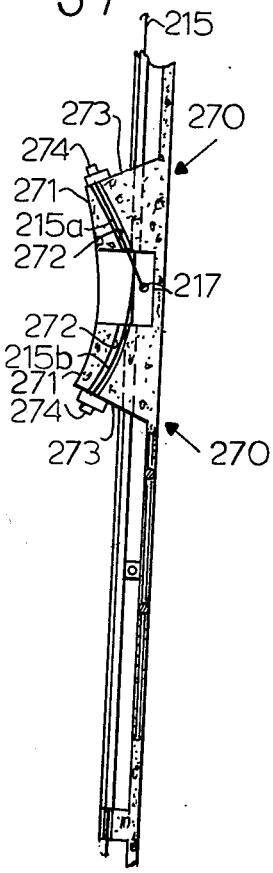
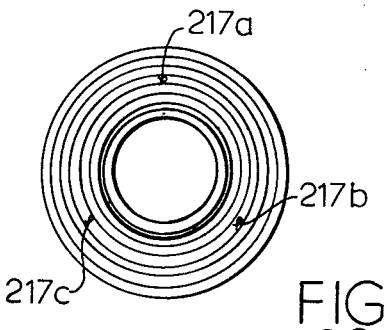
FIG. 38
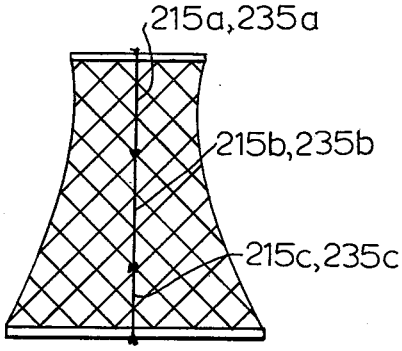
FIG. 39

COOLING TOWER, CONSTRUCTION METHOD THEREFOR AND PRECAST PRESTRESSED CONCRETE BUILDING UNITS

BACKGROUND OF THE INVENTION

This invention relates to a cooling tower of novel structure, whether in the form of a hyperbolic paraboloid or of some other shape, to a method for erecting such towers, and to a novel precast unit which plays an important part in the structure and which can be integrated by reinforcing or by prestressing or both.

High towers of hyperbolic paraboloid shape, as well as of other shapes, have been constructed for the purpose of cooling water which has been heated in a nuclear or in a fossil-fuel type of power plant. When the hot water is sprayed from nozzles inside the tower at a relatively low level, a flow of air is induced by the heat of the water, the air entering at the lower end of the tower through an open work portion and rising through the tower, thereby cooling the water so that it can be reused in the power plant or be put into streams as cool water.

These cooling towers are quite large, being several hundred feet high, and have heretofore been made either by poured-in-place concrete or by a combination thereof with precast units, and such towers have necessarily consumed a large amount of steel for reinforcement and strength. In spite of all this, in spite of the fact that smooth concrete walls of various thicknesses which have heretofore been used in such cooling towers have been ten inches or even more in thickness, and in spite of the enormous amount of both concrete and steel used, still those towers that have been erected have not been provided with sufficient resistance to earthquakes or even wind.

Those towers have been very expensive, both in the consumption of material and in the cost of erection, due to such factors as the enormous amount of steel to be erected, the enormous amount of concrete to be poured, the time intervals required for the concrete in lower portions to set sufficiently to be able to support later poured concrete portions thereabove, the very large amount of concrete that has had to be lifted by cranes to be poured, and the substantial labor costs resulting from the inefficient, time-consuming construction methods that have been used heretobefore.

OBJECTS OF THE INVENTION

An important object of the present invention is to provide cooling towers which can withstand earthquakes.

Another important object is to provide a method for construction of such towers that will significantly reduce the costs of both materials and labor.

Another object of the invention is to provide a system of erection which employs a number of precast units. These units may be prefabricated distant from the site or, if desired, poured on the ground at the site. Their use can save substantial erection time of the tower and can substantially reduce the amount of concrete that must be lifted and poured to make the tower.

Another object of the invention is to provide a novel type of such precast unit which enables it to cooperate with other such units. Steel cages may lock the units together, or they may be bolted together, while prestressing the whole. Post-tensioning cables may be spaced along and around the tower in order to provide both superior structure, reduced cost of erection, and less labor of erection.

SUMMARY OF THE INVENTION

A cooling tower of the present invention starts with the usual provision of a foundation and then the erection of a bottom open-work supporting portion, typically formed of a series of angularly-extending, triangularly-disposed columns secured to the foundation and extending upwardly from it so as to take on an overall shape of a frustum of a cone; the spaces between such columns are, of course, left open to admit the cooling air. The upper ends of the columns are joined by a horizontal ring, which is called herein a lower ring, since there will be an upper ring at the top of the tower. Both precast and prestressed upper and lower rings are a part of this invention.

Upon the lower ring is erected a reinforced concrete wall of ribbed, waffle-like structure. The ribs strengthen the structure and enable the use of quite thin wall portions in between the ribs. This wall may be made by pouring it in place or may be made up of a series of precast units, which may cooperate with a series of steel cages or may be bolted to each other. With the steel cage type of construction, as each level is erected, additional concrete or grouting is used with the steel cages to tie them and the precast units together. When the precast units are bolted to each other, additional concrete or grouting may also be used, if desired. Also, the wall preferably includes a series of vertical and horizontal or inclined post-tensioning cables and means for applying post-tensioning forces to them. Finally, at the top of the wall the upper ring is installed, preferably using a combination of precast segments, poured-in-place concrete and post-tensioning cables.

The precast reinforced panels each have ribs. The ribs may be along their edge portions, or may cross their mid-portions and intersect each other. The ribs or margins may include means for receiving post-tensioning cables and anchorages. In some type of panels, a steel cage is enclosed by portions of the ribs, which define a cavity where the adjacent panels meet and within which concrete, grout, or epoxy may be poured in place as each level is erected to fill the remainder of the cavities in the cages and tie the structure together.

The precast unit may be substantially planar and slightly curved or may actually be planar. Its inner surface may be quite smooth and the outer surface ribbed or vice versa. Several geometric shapes are feasible for these precast units. Among those discussed herein and those which are believed to be the most practical are precast units with a generally trapezoidal shape, precast units with a generally triangular shape, precast units with a generally diamond shape, and precast units of a generally hexagonal shape. Each of these shapes may have variations. For example, a diamond-shaped unit may possess vertical and horizontal ribs or sub-ribs for strengthening the thin walls and helping providing for post-tensioning tendons and anchorages. Due to the huge size of the cooling tower itself and the relatively small size of each of the precast units, the divergencies in curvature are generally not significant, unless extremely large units are used.

In one approximately trapezoidal type of precast unit, shown by way of example, there is a main wall with a smooth interior face, an upper edge which is shorter than the lower edge, and a pair of identical side edges, so that the trapezoid is isosceles. A pair of vertical ribs extend outwardly from the main wall near and parallel to their respective side edges and set inwardly from them. Each of these ribs may be L-shaped in vertical cross section, although other forms are discussed and are within the scope of the present invention. When the ribs are approximately L-shaped in vertical cross section, they have an outwardly-extending arm and a sideways-extending arm ending in an edge that is approximately in the same plane as the adjacent side edge of the main wall. The ribs extend downwardly below the lower edge of the main wall, whereas their upper edges lie below the upper edge of the main wall. The ribs may be reinforced in two directions by steel rods, or may be post-tensioned by cables and anchorages. An horizontal rib, which is also reinforced in two directions by steel, extends forward from the lower edge of the main wall and is stepped down along the outer surface of the main wall in line with the interior face thereof. An upper surface of the horizontal rib is inclined downwardly from the outer surface of the main wall to the bottom portion thereof having a front face in line with front faces of the two vertical ribs, the horizontal rib being unitary and continuous with them. A bottom surface of the horizontal rib extends outwardly from the end of the step to the lower edge of the front face in a plane parallel to and below the plane of the lower edge of the main wall.

At some suitable location on the precast trapezoidal unit, horizontal and vertical post-tensioning cable-seating grooves may be provided. It is to be understood that the cable-seating horizontal groove of each precast unit will be in registration with such grooves of all other units emplaced at the same level of the tower, so that the horizontal post-tensioning cable will circumferentially girdle the tower to strengthen it. Similarly, the units and their vertical grooves are aligned, and vertical post-tensioning cables serve as wind-resisting elements by being anchored to the lower ring or the foundation.

As another example, diamond-shaped precast units may be provided, and a half-diamond or triangular unit may be used at the bottom, just above the lower ring. These units may have hollow horizontal ribs and hollow vertical ribs, both of which are so aligned with the corresponding ribs of other units that they can receive prestressing cables. Some units provide jack anchorages. The units themselves may be bolted together directly at edge flanges, no steel cages being required by this type of unit. Grouting may, however, be used in between adjacent units for further integration.

While alternative structures, such as hexagonal units, are within the present invention, they will not be detailed in this Summary, except that it will be understood that, again, each unit has ribbed edges with means defining structure which will form, in cooperation with an adjacent slab, a suitable contact or cavity.

In the method of the invention the erection of the tower is generally standard up to the lower ring in which post-tensioning tendons are placed. From there on the erection proceeds in a novel manner, depending on the embodiment of the invention to be used. For example, an upwardly-extending first series of steel cages may be placed at intervals around the ring, and this may be followed by placing a first series of precast reinforced concrete units between adjacent steel cages, inserting a post-tensioning cable in the units to go around the circular circumference, and then pouring concrete into the cavities provided by the precast units, these cavities being those in which the steel cages at this time lie to key the units together. Then a next series of panels may be erected upon the first series by first installing the cages and then the panels and the post-tensioning cable and then pouring concrete. This procedure is continued up to the top of the tower where an upper ring having a post-tensioning cable is then provided.

As another example, a series of triangular ribbed precast units may be erected in and secured to a channel-shaped lower ring member and integrated therewith by pouring concrete in the channel-shaped member after also emplacing therein a post-tensioning cable or cables. Then diamond-shaped ribbed precast units may be bolted to the triangular units, and successive tiers of diamond-shaped units bolted to the next lower tier of the same type of unit. Post-tensioning tendons may be inserted horizontally and vertically and/or diagonally and jacks anchored at chosen locations. Grouting may be done tier by tier. Finally, an upper row of inverted triangular units may be followed by the upper ring.

The horizontal and vertical ribs which are provided as a result of this invention strengthen and stiffen the walls so that the needed strength is achieved, while at the same time they reduce substantially the total amounts of steel and concrete required for the tower. It is to be noted that the ordinary use of slip-forming would be inefficient and uneconomical in forming the required ribs and, in fact, ordinary slip-forming might be substantially impossible. In contrast, the use of the precast units in connection with the interlocking steel cages enables a very efficient and relatively low-cost construction of these huge and expensive towers. With the rib sections extending in two or more directions stiffening is especially efficient, and the various patterns shown in the drawings will exemplify shapes that satisfy the strength and stiffening requirements while optimizing the costs of labor, materials, and the time of actual construction.

The actual size of the precast panels will depend upon the capacity and reach of the handling equipment and cranes, which may be of the conventional type or may involve some special designs and arrangements, if that is desirable. The size of the precast units may also be influenced by the cost of forming, the cost of joining, and so on.

The shape, form, and size of the precast units to be used will be determined by the design engineer for the particular tower. He can work out by calculation the best size and stiffness of ribs required for the particular size of the tower and can weigh the complexity which may be required in forming, handling, and joining the units together against other factors in determining the ultimate size and shape of the precast units. While it may be desirable to keep the number of forms to a minimum, at the same time the forms must be such as to accommodate the different curvatures that are required for the tower along its height.

A minimum of in-place forming is preferably used in the present construction, and in some instances it may be possible to dispense completely with such forming. By preforming the edges of the precast units so that when two adjacent units are placed together, they may be joined together by bolts or by an epoxy composition, or their edges may serve as a form for the poured-in-place concrete; thus, forms can be substantially eliminated in construction of the tower. With reinforcing steel cages located even before the units are erected and then enclosed in the cavity provided by the adjoining edges, fresh concrete can be grouted into the cavity in such a way that forms are completely avoided for the full height of the tower. Similarly, the diamond-shaped units to be described eliminate the need for forms. Edge joiners of various types will be used in the present invention and some will be described.

The use of the post-tensioning cables, which may extend circumferentially and vertically around the tower or in hyperbolically-opposed pairs along the height of the tower or both, enables great strengthening at relatively low cost. The tendons can be tensioned in stages or several tendons can be coupled together as the construction advances.

Other objects and advantages of the invention will appear from the following description of some preferred embodiments.

BRIEF DESCRIPTION OF THE DRAWINGS

In the drawings:

FIG. 1 is a somewhat diagrammatic view in side elevation of a hyperbolic paraboloid cooling tower embodying the principles of the invention. A portion of the earth is broken away at the base to show the foundation slab on supporting piles.

FIG. 2 is a top plan view looking down into the hyperbolic paraboloidal interior of the cooling tower of FIG. 1, along the line 2—2 in FIG. 1.

FIG. 3 is a view on a reduced scale with respect to FIG. 1 of an early stage in the erection of the cooling tower in which the piles, foundation, and initial series of supporting columns and lower ring thereon are in place.

FIG. 4 is a view similar to FIG. 3 of a succeeding stage of one form of construction of the tower of FIG. 3, according to the present invention, with the lowest segments of the steel cages being emplaced upon the lower ring.

FIG. 5 is a view similar to FIG. 4, showing the construction at a later stage in which the panels have been put in place and grouting applied in the cavities between panels.

FIG. 6 is a similar view showing a crane being used in a succeeding stage of erection with a second tier of steel cages extending upwardly from the lower segments and a slab being introduced between two upwardly-extended cage segments.

FIG. 7 is a diagrammatic top plan view of the tower showing one feasible location of a crane for construction, the crane being located within the circumference of the tower.

FIG. 8 is a similar view to FIG. 7 in which a traveling crane is supported by the tower wall itself.

FIG. 9 is a similar view to FIG. 7 and shows a pair of traveling cranes in use, with one within the tower and the other outside the tower wall.

FIG. 10 is a fragmentary view in elevation and in vertical section of a lower portion of the tower, on a somewhat larger scale from FIG. 1, showing how the water to be cooled is introduced and also showing the asbestos panels inside the tower.

FIG. 11 is a fragmentary view in elevation on a still somewhat larger scale, showing a lower portion of the tower at an early stage of erection, with the supporting columns and lower ring in place and a steel cage erected thereon, the upper end of the cage being broken off to conserve space.

FIG. 12 is an isometric view of one form of a precast unit embodying the invention. The unit is generally trapezoidal. The concrete of the unit has been cut away on a vertical segment to show two-directional inner reinforcement structure.

FIG. 13 is an enlarged view in vertical section taken along the line 13—13 of FIG. 1 showing three precast units superimposed leading to the upper end of the structure. As seen in FIG. 13, the topmost row of precast units provides a U-shaped form for the upper ring.

FIG. 14 is a further enlarged view in section taken along the line 14—14 in FIG. 13.

FIG. 15 is a small diagrammatic view in elevation of a tower construction of the present invention, in which the precast units are of generally diamond configuration.

FIG. 16 is a fragmentary, partly diagrammatic view in elevation of a superposed pair of diamond-shaped precast units and in evenly dashed lines the hidden portions of interlocking steel cages. Portions are broken away to show the structure. In broken center lines can be seen what would be the defining lines if all the panel members were triangular instead of diamond-shaped, the bottom row being triangular here anyway.

FIG. 17 is a view similar to FIG. 15 of a modified form of tower construction in which the precast units are of generally triangular geometry.

FIG. 18 is a fragmentary plan view of portions of two adjacent precast units about to be joined together, the view exemplifies a different shape of vertical ribs and cavity and a different type of steel cage than that shown previously. The units spaced apart for clarity of description, are about to be joined.

FIG. 19 is a view similar to FIG. 18 showing another different form of cavity and steel cage.

FIG. 20 is yet another view of joining structure similar to those shown in FIGS. 18 and 19.

FIG. 29 is a somewhat diagrammatical view in elevation similar to FIG. 3 showing a succeeding stage of construction wherein the precast unit of FIG. 28 is to be used; this view of a base series of triangular slabs is shown in place on the lower ring.

FIG. 30 is a fragmentary enlarged view in perspective, partly broken away, of a portion of FIG. 29, illustrating the stages of emplacing the base series of triangles in the lower ring.

FIG. 31 is a view in elevation similar to FIG. 4 showing the lowest tier of diamond-shaped ribbed units in place and secured to the base triangular slabs.

FIG. 32 is a fragmentary enlarged view in elevation of a portion of FIG. 31 illustrating the attachment of the diamond-shaped units to the triangular units.

FIG. 33 is a view similar to FIG. 32 showing the next tier of diamond-shaped units in place and secured to the lower tier of similar units and illustrating the use of prestressing cables.

FIG. 34 is a fragmentary view in elevation, partly broken away, on an enlarged scale of a portion of a tower wall made of the diamond-shaped units in FIG. 28 secured together with post-tensioning cables and with bolts, the wall containing a locus when two horizontal cables are anchored, with overlap.

FIG. 35 is a further enlarged view in section taken along the line 35—35 in FIG. 34. Tilt has not been shown, in order to save space.

FIG. 36 is a fragmentary view on the scale of FIG. 34 showing another portion of the wall of FIG. 34 where two vertically-extending post-tensioning cables meet with overlap and anchorage.

FIG. 37 is a further enlarged view in section taken along the line 37—37 in FIG. 36.

FIG. 38 is a top plan diagrammatic view of the tower made according to FIGS. 28–37, showing how there may be three horizontal post-tensioning cables per tier.

FIG. 39 is a small, somewhat diagrammatic view of the tower showing how there may be three vertical post-tensioning cables in series for each slab stack.

FIG. 40 is a somewhat enlarged fragmentary view in elevation, partly broken away, of the top portion of the wall made for diamond-shaped units.

DESCRIPTION OF SOME PREFERRED EMBODIMENTS

Figure 25:
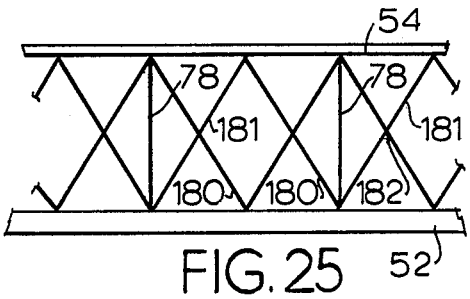
FIG. 25 is a diagrammatic view in elevation of one feasible column arrangement at the base of the tower, with cross-over formation.
Figure 26:
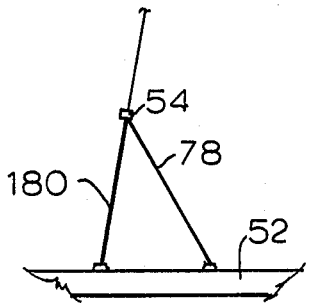
FIG. 26 is a diagrammatic view in elevation related to FIG. 25 and may be considered as taken at right angles thereto.

General considerations:

While the invention is not limited to hyperbolic paraboloid cooling towers, or even to cooling towers, such uses are contemplated as important uses of the present invention. Therefore, FIG. 1 is a somewhat diagrammatic view in side elevation of cooling tower 50 resulting from the principles of the present invention and the tower 50 is illustrated as having an hyperbolic paraboloid configuration. Again, by way of example only, foundation piles 51 are shown driven into the earth as a first stage of construction, although piles may not be necessary or even advisable in many instances, for example spread footings may be used. The tower 50 is, again as an example only, shown with a continuous supporting foundation or base pad 52 which rests upon the piles 51 (if no piles are needed, the pad 52 may rest upon solid rock, spread footings, or other suitable structure). Upon the foundation 52 is erected a series of supporting columns 53 which are strong members generally inclined both inwardly and to one side or the other. They may be steel or prestressed concrete. These columns 53 are placed circumferentially about the periphery of the foundation 52, and in appearance outwardly resemble a frustum of a cone. Various configurations of these supporting columns 53 may be made, as will be shown later in connection with the discussion of FIGS. 11, 25, and 26. The upper ends of the columns 53 are secured together by a lower ring 54, which is an important part of the structure and which is preferably made of precast and/or prestressed concrete.

Above the lower ring 54 is the main body or veil of the cooling tower, a circularly circumferential wall 55 of ribbed or waffle-like appearance. For example, the inner surface of the wall, as shown in FIG. 2, may be smooth although made up of a series of member 56 grouted at the seams of joinder, which the outer surface of the tower 50 may be ribbed with both vertical ribs 57 and horizontal ribs 58, the ribs 57 and 58 projecting outwardly and showing up clearly. These ribs 57 and 58 are a very important structural feature of the invention and provide the needed stiffness to go with a thin skin portion inside of the ribs of each member 56. Finally, at the upper end of the wall 55 is an upper ring 59 which completes the structure 50.

An example of one general method of construction (FIGS. 3–9):

The piling 51 and the foundation 52 may be made in a standard manner, and the erection of the columns 53 may be standard or may involve some special practices which are discussed later on. FIG. 3 shows the stage of erection in which the piling 51, foundation 52, columns 53, and the lower ring 54 are in place. Each stage of the construction up to this point is, of course, quite important but, with the exception of the lower ring 54, involves standard construction practices; accordingly, the details thereof are omitted to avoid obscuring the principles of the present invention.

As brought out above, the lower ring 54 is preferably made of precast prestressed concrete including cables, which will be circumferentially stressed. The structure of the ring 54 is quite important and involves several departures from the prior art, which are described below in connection with FIG. 11.

The basic function accomplished by the lower ring 54, as shown in FIG. 3, is to provide a suitably designed structure for supporting and stiffening the remainder of the tower 50. The openwork column 53 construction, when properly based upon a suitable foundation 52 is quite capable of providing the necessary support, and the upper ring 59 when tying the uppermost row of units 56 together, aids the lower ring 54 in obtaining the necessary strength and stiffness within the entire tower construction 50.

Figure 27:
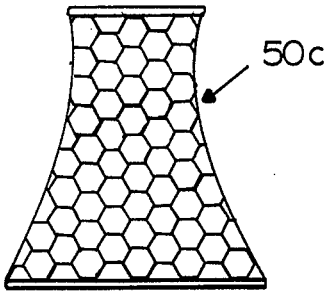
FIG. 27 is a view similar to FIGS. 16 and 17 of a tower constructed from ribbed hexagonal panels.

FIG. 4 shows the beginning of the construction of the wall or veil 55. In the particular mode of the invention shown here, a series of steel cages 60 are erected upon the lower ring 54. The specific structure of the cages 60 will be described later; here, it will be sufficient to note that many different forms of steel cages can be used, some of which will be described below, and the cages can be erected in various patterns. As an example, FIGS. 4–6 show the erection of a tower 50 like that of FIG. 1 in which the individual sections 56 of the veil 55 are generally trapezoidal in shape, and the cages 60 are in the form of generally vertically-extending posts, inclined inwardly and slightly toward each other, to define sides of trapezoids. The method of erection may remain substantially the same except for differences of detail when diamond, triangular, or hexagonal shapes are provided, or may be rather different, as shown in FIGS. 27 on. With those shapes, the cages 60 are, of course, aligned in different directions though still in between contacting side ribs of slabs, as is apparent from the examples of FIGS. 15, 16, and 17, discussed hereinafter.

With the steel cages 60 in place as shown in FIG. 4, a first series 61 of the precast units, panels, or slabs 56 is erected, as shown in FIG. 5. The slabs 56 may be poured in place on the ground adjacent the tower or at some other convenient location and brought to the construction site; they may be erected by suitable cranes (See FIGS. 7–9). The panels 56 are placed temporarily between the steel cages 60, and post-tensioning cables (not shown here but shown later) are put in place. Then the whole series or tier 61 of the panels 56 or, in other words, the tower up to the height of a single slab 56, may then all be joined together by grouting the joints between adjacent panels in the cavities largely occupied by the cages 60. More details will be given later, but for the present the important sequence is that after the lower ring 54 is in place the steel cages 60 are erected thereon, and they are used to hold the slabs or panels 56 in place until the grouting is completed with all the circumferential post-tensioning cables for that tier 61 in place, and then one goes to the next stage which is shown in FIG. 6.

FIG. 6 shows all the steel cages 62 for the next tier 63 in place. In this form of the invention, the cages 62 are erected as continuation of the underlying cages 60 of the lowest level. One slab of the tier 63 is shown being placed between two adjacent steel cages 62 by a crane 64. Eventually, each slab 56 of the tier 63 (one is shown being lowered by the crane 64), will rest upon an underlying slab 56 of the series 61. The construction operation continues upwardly, tier by tier, until the entire wall or veil 55 is completed, and the upper ring 59 is then formed upon the uppermost series of slabs 56.

Different dispositions of cranes may be made and thus FIGS. 7, 8, and 9 show cranes 64 in different locations relative to the tower 50. FIG. 7 shows a stationary crane 64 with rotatable arm centrally positioned inside the tower. FIG. 8 shows a traveling crane 64 movably mounted to the inside structure of the tower as another convenient way to operate the crane. FIG. 9 shows one traveling crane 64 on the inside of the tower and another traveling crane 65 movably mounted on the outside of the tower. All of these crane positions and techniques are suitable for practicing the invention.

The plumbing and related elements (FIG. 10):

At a suitable stage, the plumbing may be installed. FIG. 10 shows a portion of a tower 50 with the plumbing and other related features in place. Thus, a pipe 66 passes through a wall or veil 55 at height not too far above the lower columns 53. The pipe 66 is provided with a series of sprinkler heads 67 which spray out the hot water. They may do this either downwardly or upwardly, or both, preferably filling the area with water droplets, and the pipe 66 for this purpose may describe a ring, a series of rings, or any other pattern enabling the heated water in the pipe 66 to be sprayed effectively over the area of the base of the tower 50.

Below the water sprinkler 67, the foundation 52 is provided with a recess or pond 68 in which the cooled water accumulates, and a series of supporting panels 69 of asbestos or other material may be provided to collect some of the water and enable its cooling. All this is standard and although it must, of course, be taken into consideration, it does not greatly affect the practice of the present invention.

The first stage of erection through FIG. 3 (referring also to FIG. 11):

The erection of the columns 53 may be done in a special manner. In this special manner the foundation 52 is provided with upstanding short stubby pier members 70 having an upper face 71 which is properly slanted. To this face 71 is affixed a steel plate 72. The columns 53 may be precast prestressed concrete columns 73 having steel plates 74 and 75 at their ends. The plate 74 may be welded or bolted to the plate 72 to erect the column 73, and then a precast arcuate form member 76 provided with a steel plate 77 on its lower surface may be secured as by welding or bolting to the plate 75 at the upper end of the colum 73. An interior bracing column 78 on a bracing pier 79 may be made in the same manner exactly and secured in the same basic manner or may be doweled to the column member 73 and grouted to it.

The lower ring 54 may thus comprise a series of channel members 76 joined together and serving as a form for pouring a core 80 of concrete containing suitable post-tensioning cables 81. The small size of the drawings should not mislead or confuse anyone—this cooling tower structure is huge, and its strength will be enormous when it is properly made. Reinforcing rods may be used if desired to supplement the tendons 81, which are then stressed according to the normal practice in making prestressed concrete.

As can be seen from FIG. 11, a series of steel cages 60 is there erected upon the lower ring 54, and the structure there thus corresponds to that of FIG. 4.

A trapezoidal type of precast slab or panel (FIG. 12):

An example of a trapezoidal precast panel 90 is shown in FIG. 12. The panel 90 has an upper edge 91, a lower edge 92, and side edges 93 and 94. Most of the panel 90 comprises a thin skin 95 having both vertical reinforcing rods 96 and horizontal reinforcing rods 97 therein. Such a slab 90 may be ten or twenty feet tall, or it may be somewhat larger or somewhat smaller, and the thin skin 95 may be only two or three inches thick, for example.

The skin 95 is integral with a pair of L-shaped vertically-aligned ribs 100 and 101 which are joined to the skin 95 not only by the concrete but by reinforcing members 98 embedded in the concrete. Both ribs 100 and 101 are L-shaped in configuration, having an outwardly-extending portion 102 and then a portion 103 generally parallel to the skin portion 95 and with an edge 104 which is approximately in the same plane as the edge 93 or 94, as the case may be. The ribs 100 and 101 have an upper end 105 which is spaced down from the upper edge 91, and the ribs 100 and 101 extend much lower down, to a lower edge 106 which is stepped below the lower edge 92. This lower portion of the ribs is joined to the skin 95 by a generally diagonally-extending surface 107 defining a horizontal rib 108 with a lower edge portion 109 co-planar with the portion 106 and then a stepped portion 110 leading up to the edge 92. A suitable recess 111 may be provided to accept one of the post-tensioning cables 112 (See FIG. 13).

The stacking relationship between the slabs 90; the uppermost slab 113 (FIG. 13):

FIG. 13 shows how the construction of the lower rib 108 is related to the upper edge of a similar slab 90 to provide a linking structure so that the upper slabs 90 are securely nested on the lower slabs 90, thereby facilitating construction. It also shows one of the preferred placements of the post-tensioning cables 112 in the recesses 111 in the lower horizontal ribs 108.

FIG. 13 also shows an uppermost slab 113, which is provided at its upper end with a channel 114, like the channel 76 used for the lower ring 54. The channel 114 is used to form the upper ring 59. When the entire uppermost tier of slabs 113 are properly joined together and post-tensioning cables 116 put in place, concrete 115 is poured into the channel 114. This is a preferred structure for forming the upper ring.

The tying together of the slabs and steel cages (FIG. 14 with some reference of FIGS. 13 and 11):

As stated earlier in the example being discussed, the steel cages 60 are first put in place. FIG. 14 illustrates how the cages 60 can be used to lock in place and support the panels 90. There is a steel cage 60 at each end of each panel 90, and the flanged edge portion 100 or 101 of the panel 90 can rest on the two cages 60. It will be noted that the shape and size of the U-shaped cavity defined by the margin of the slab 90 and the portion 102 and 103 are such that the U-shaped cavity of one panel 90 surrounds half of the steel cage 60, and the similar cavity of the adjacent panel 90 surrounds the other half; moreover, the two panels 90 meet along the edges 93,94 and the edges 104,104, so as to provide a rectangular-shaped channel 122 that completely surrounds the steel cage 60 and provides, in itself, a form for receiving concrete grout 123. The grout 123, in which the steel cage 60 is embedded locks the adjacent panels 90 together and secures them also to the cage 60.

FIGS. 11 and 14 show that the steel cage 60 may comprise a set of four angle irons 117 joined together by steel bars 118 and 119 to make a generally rectangular box construction which is largely open, except at the relatively small corners, providing a hollow interior 121. This structure can be quite strong, and it can be used to enclose one (or more) vertical post-tensioning cable 120, if that be desired. Thus, with the steel cages 60 erected, the slabs 90 placed over them, and a complete ring of them formed, and with the horizontal post-tensioning cable 112 seated in the cavity 111, and preferably, the vertical post-tensioning cables 120 in place within the cages 60, the first tier 61 is ready to grout, and the grout 123 may be poured into each vertical channel or cavity 122 and the hollow cage interior 121 between the slabs 90 to provide a very solid linkage joining together the complete circle of units 90 on each tier.

Tower construction with mainly diamond-shaped units 130 (FIGS. 15 and 16):

FIGS. 15 and 16 broadly illustrate how a hyperbolic paraboloid cooling tower 50*a* may be constructed from superposed quadrilateral units 130 which, in the figures, are diamond-shaped. With this construction configuration, two series of cages 131 and 132 extend between the lower ring 54 and the upper ring 59. The first series 131 extends upwardly and to the left relative to the lower ring 54, while the second series 132 extends upwardly and to the right; the cages 131 and 132 periodically intersect at joinder locations 133 and thereby define the locations of the units 130.

As FIG. 16 shows, the diamond-shaped units 130 may be constructed much like the trapezoidal units 90, already described, except that the diamond-shaped units 130 have in addition to a thin skin 134, ribs 135, 136, 137, and 138, structure defining cavities and contact edges on all four sides thereof, so that the cages 131 and 132 may be accommodated therein and so that the units 130 may thereby be locked together.

In constructing a tower like that of FIG. 15, made principally of diamond-shaped units 130, a bottom row of triangular units 139 is first recessed to the lower ring 54. Then cages 131 and 132 are placed in segments no longer than the upper side lengths of the units 139. A tier of units 130 is then put in place and grouted, preferably with post-tensioning cables in the cages 131 and 132. Then the cages 131 and 132 are extended up over the upper edges 137 and 138, the next tier of units 130 added, and grouting is done again. At the top, there will again be a series of triangular units and the upper ring 59, with which they may be integral.

The units 130 may be provided with exterior horizontal and vertical ribs or grooves with holes to accommodate circularly circumferential as well as vertical post-tensioning cables, in accordance with the principles of the present inventions. The grooves may be greased or may be grouted after the cables are emplaced and tensioned, as has already been described. Alternatively, the vertical cables may be positioned axially within the cages 131 and 132, as already shown and described in connection with FIG. 14.

Tower construction with triangular units 139 (FIG. 17) or hexagonal units (FIG. 27):

A further variation in precast unit configuration, illustrative of the wide range of useful geometry, is set forth in FIG. 17. Therein a tower 50*b* is constructed of rows of circumferentially-placed triangular units 139. In the bottom tier, the triangular slabs 139 have their base at the bottom and their apex at the top, while in the next upper tier, the triangular slabs 139 are inverted, with their base at the top and apex at the bottom. The formation of the units 139 is quite like that of the diamond-shaped units 130 and of the triangular slabs 139 of FIG. 16. If the units 130 were bisected horizontally and then ribbed there, the shape would be like the slabs 139.

With triangular units 139, the cage construction may be the same as that used for the diamond-shaped units 130. The angled side walls of the units 139 have rib structures providing cavities for the cages 131 and 132, while the horizontal base edges may have the complementary-stepped construction of the top edge 91 and bottom edge 92 of the trapezoidal panel 90. Thus, the top base edges of the inverted triangular units 139 may have a geometry corresponding to the top edges 91 of the panels 90, while the upright triangular units 139 may have bottom base edges corresponding geometrically to the bottom edges 92 of the panel 90, including the sloping rib 107. Circularly circumferential post-tensioning cables would be included in the manner described in the discussion of the structure of FIGS. 12 and 13 hereinabove. Vertically-extending or diagonally-extending post-tensioning cables may also be included in the construction of the tower of FIG. 17 in accordance with the methods and configurations already described.

Hexagonal panel structure is also feasible, as shown in FIG. 27 where a tower 50*c* is made with steel cages substantially as shown in FIG. 15.

Some Joinery Modifications (FIGS. 18–24)

Vertical rib modifications (FIGS. 18, 19, and 20):

Although the L-shaped vertical ribs 100 and 101 are shown as a preferred form in connection with the trapezoidal units 90, as described in connection with FIG. 12, above and although they will also work for diamond-shaped, triangular, and hexagonal panels, with obvious modifications), there are other geometric shapes which work well, and a few exemplary shapes are shown in FIGS. 18, 19, and 20. It is to be understood that particular shapes for the vertical ribs will be specified by the design engineer for the tower, with due regard being given to the structural, functional and architectural requirements thereof.

In FIG. 18, panels 140 and 141 are provided with symmetrically-opposed, slanting vertical ribs 142 and 143, respectively. A pentagonal recess 144 is defined by a right rib 142, a left rib 143, and the marginal skin portions 145 of the panels 140 and 141. When the panels 140 and 141 are placed together they engage each other, and the single pentagonal cavity is formed. Steel tee columns 146 and 147 may be placed in the pentagonal cavity and provided the same supporting, reinforcing, and keying functions as the steel cages which have already been described. The tee colums 146 and 147 may be connected together periodically by triangular connecting members 148 therebetween to form a unitary supporting post in the cavity. Grout fills the cavity after emplacement of the tee columns and the panels and post-tensioning of the post-tension cables, in accordance with the principles already described.

FIG. 19 illustrates adjacent panels 150 and 151 having vertical ribs 152 and 153, respectively. The ribs 152 and 153 are shown to be oppositely complementary U-shaped constructions which together define a generally rectangular cavity 154. Two tee columns 155 and 156, preferably connected together by triangular connecting members 157, may be placed in the cavity 154 to lock the panels 150 and 151 in place. Then, grout may be placed into the cavity 154.

FIG. 20 is a modification of the U-shaped construction shown in FIG. 19. Therein, panels 160 and 161 are provided with Vee-shaped vertical ribs 162 and 163. The ribs, when adjacently placed together and seen to define a hexagonal cavity 164, in which two tee columns 165 and 166, which are connected together by triangular connecting members 167, are positioned. Again, concrete grout may be placed into the cavity 164 in the construction process.

In the structure of FIGS. 19 and 20, the inner wall will not be completely smooth, but considering the dimensions involved, the divergence from the smooth surface is functionally insignificant.

Horizontal step joinder modifications (FIGS. 21, 22, 23, and 24):

Besides the stepped construction of the horizontal edges of the panels 91, as described in connection with FIGS. 12 and 13 above, there are a number of other horizontal joinder configurations. FIGS. 21, 22, 23, and 24 illustrate a tongue and groove configuration, with variations.

Figure 21:
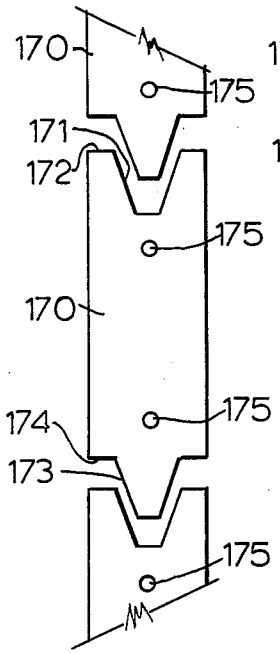
FIG. 21 is a view in vertical section showing superposition of units and one type of arrangement of horizontal post-tensioning cables for prestressing the concrete, with cooperating cavities through the panels to receive the post-tensioning cables. The panels are shown spaced apart vertically; when fully installed, they are in firm contact with each other and are locked together.

In FIG. 21 precast slabs 170 are provided with a V-shaped groove 171 in the upper edge 172, and a mating V-shaped tongue 173 projecting downwardly from the bottom edge 174. The tongues 173 seat in the grooves 171 to provide a secure vertical interlock of superposed slabs 170. Post-tensioning cables 175 may be placed within suitable cylindrical passages within the body of the slabs 170.

Figure 22:
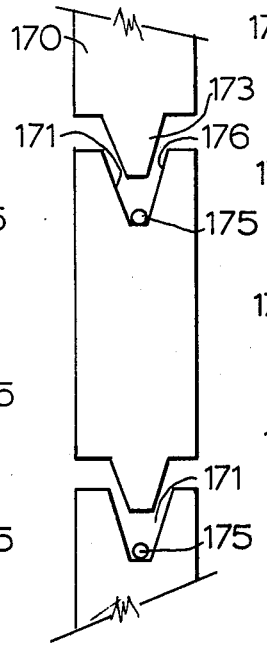
FIG. 22 is a view similar to FIG. 21 with a different location of the horizontal post-tensioning cables.

The structure shown in FIG. 22 is the same as that of FIG. 21, except the post-tensioning cables 175 are laid in the V-grooves 171. Such a placement of the post-tensioning cables 175 may be advantageous. For example, each of the circularly circumferential cables 175 may be shortened and initially rest against an inner side wall 176 which in part defines the V-groove 171. After all of the overlying slabs have been seated in place, the tongues thereof in combination with the weight thereof force the cable 175 to the bottom of the V-groove 171, thereby stretching the cable 175 to a desired post-tensioned state.

Figure 23:
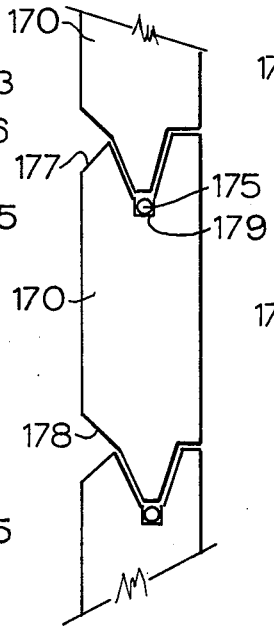
FIG. 23 is a view similar to FIGS. 21 and 22 with another different location of the post-tensioning cables and an architectural refinement along the outside surface. The panels are shown closer together, approximately as they would be just before grouting.

The structure of FIG. 23 is like the configurations of FIGS. 21 and 22, except that the slabs 170 have been provided with slanted portions 177 and 178 at the top and bottom edges thereof to create a pleasing architectural detail. Also, the post-tensioning cables 175 are seated in a special channel 179 provided for that purpose at the bottom of each V-groove 171. After the cable 175 is placed and post-tensioned, it may be grouted in the channel 179 before, or concomitantly with the placement of a next higher slab 170 thereon.

Figure 24:
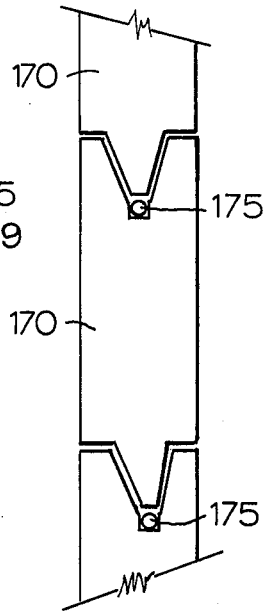
FIG. 24 is a view similar to FIG. 23 but without the architectural refinement of that view.

The structure of FIG. 24 is identical to that shown in FIG. 23, except for the omission of the slanting edge portions 177 and 178.

Some base structure modifications (FIGS. 25 and 26):

In addition to the triangularly aligned columns 53 illustrated in FIGS. 1, 3, 4, 5, and 6, another arrangement of the columns extend between the foundation pad 52 and the lower ring 54 in a crisscross pattern. Each of a first series 180 of columns angles upwardly to the left from the pad 52 while each of a second series of columns 181 extends upwardly to the right, slanting inwardly. Each column 180 bisects a column 181 at a junction 182 which may be unitary to provide additional strength. Periodically, for example, at every other pair of columns 180,181, the lower ring 54 may be additionally braced by emplacement of the interior bracing columns 78, already described in connection with FIG. 11, above.

Figure 28:
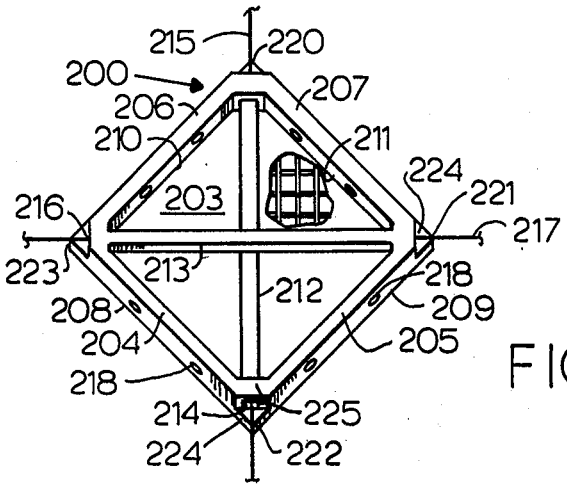
FIG. 28 is a view in perspective of a generally diamond-shape precast unit embodying the principles of the invention. The skin is partly broken away to show reinforcing rods, and post-tensioning tendons are shown extending beyond each of the four corners thereof.

An alternative tower construction without steel cages (FIGS. 28–40):

An even simpler method of constructing a tower and the materials used therein, are shown in FIGS. 28 through 40. FIG. 28 shows a different form of diamond-shaped slab or unit 200 that may be used to construct the wall or veil of a tower. The initial stages of construction may be identical with those shown in FIG. 3 and the lower portion of FIG. 11; however, beginning with the lower ring 54 and as shown in FIG. 29, a somewhat different construction is used employing, first, a tier 201 of triangular slabs 202 and then many tiers of diamond-shaped slabs 200.

The diamond-shaped precast unit 200 shown in FIG. 28 has a thin (i.e., a 4-inch thick) skin 203, strengthened by reinforcing rods, and has ribs 204, 205, 206, and 207 along the margin of each edge 208, 209, 210, and 211. In addition to these ribs there are two intersecting ribs 212 and 213, one vertical and the other horizontal. The vertical rib 212 is the thinner of the two and has a central passage 214 to accept a vertical tendon, such as a post-tensioning cable 215, while the horizontal rib 213 is thicker and has a passage 216 to accept a horizontal tendon, such as a cable 217. As shown in the drawings, the marginal ribs 204, 205, 206, and 207 may be rectangular in cross section, as may the vertical and horizontal ribs 212 and 213. Each of the marginal ribs 204, 205, 206, and 207 is provided with a plurality of bolt-receiving openings 218, as many as may be desired. At the four corners 220, 221, 222, and 223 is a recessed portion 224 and a splayed rib portion 225. The recessed portion is continuous with the skin 203 and of the same thickness. This helps in threading the prestressing tendons 215 and 217 from one slab 200 to the next, since the passages have their open ends at these loci.

Adjacent slabs 200 can, as a result of this structure, be directly bolted together and then grouting can be used to tie the units 200 together even more. Prestressing is relied on, and the recesses 224 and splays 225 provide a generally square receptacle 226 (See FIG. 34) for grouting there. Plastic covers 227 (See FIG. 35) may be used during this grouting operation to help confine the grout.

The slabs 202 used at the bottom are substantially like the diamond-shaped units 200 in most particulars. These triangular bottom units 202, as shown in FIGS. 29 and 30, may have a horizontally-extending rib 230 through which or beside which a prestressing tendon 231 (FIG. 35) may be placed. The units 202 each have a vertically-extending rib 233 with a passage 234 for a prestressing tendon 235, and two ribs 236 and 237 on the two upwardly-extending sides, which are substantially identical to the marginal ribs 206 and 207 on the diamond-shaped unit 200 and which have bolt openings 238 matching the openings 218 on the ribs 204 and 205. Truncation may be applied as needed either to the bottom row of diamond-shaped units 200 or otherwise to enable satisfactory fitting together.

As shown in FIGS. 29 and 30 (and also somewhat in FIG. 35) the lower ring 54 may be made up of ring segments 240, provided with vertical sides 241 and 242 rising from a bottom wall 243 and defining a channel 244. The triangular units 202 may be placed in the channel 244. A metal member 245 having two portions 246 and 247 meeting at a vertex 248 is secured by bolting the portion 246 to the rib 236 or 237, and the portion 247 is bolted to the bottom wall 243. The ribs 236 and 237 may be recessed to receive the portion 246. When all the units 202 have been so bolted and the horizontal prestressing tendon or tendons 231 is or are tightened (See FIG. 30), a lower tier 250 of diamond-shaped units 200 may be bolted to the units 202 (FIGS. 31 and 32) and also to the bottom wall 243 of the ring. Vertical tendons 235 may be pushed up into the passages 234 and vertical tendons 215 may be pushed up into the passages 214. For this purpose the bottom wall 243 of the ring segments 240 may be provided with vertical bolt openings 251 and tendon passages 252 and suitable receptacles 253 to receive heavy plates 254 and cable anchorages 255 and the like. Then the concrete 256 (FIG. 35) may be poured into the channel 244 completing the ring 54 and anchoring both the bottom triangular tier 201 and the lowest tier 250 of diamond-shaped units 200. Grouting may be applied to the juncture of the units 200 with the units 202 along the mating faces.

With the stage shown in FIGS. 31 and 32 completed, the second tier 260 of diamond-shaped units 200 is installed, as shown in FIG. 33. This tier 260 has vertices 261 that lie above the apex of the triangular member 202, and its units 200 are themselves bolted to the first tier 250 of diamond-shaped members. The bolting being completed, grouting can be done, as before, and the prestressing cables threaded horizontally and vertically, as desired. This action continues up to substantially the full height of the tower.

It may be desirable to have the prestressing tendons much shorter than the full circumference of the tower or the full height of the tower. For example, each of three horizontal tendons **217*a*, 217*b*, and 217*c*, may be slightly longer than one-third of the circumference at the particular location, and each vertical tendon 215*a*, and 215*b*, and 215*c* or 235*a*, 235*b* and 235*c* may be slightly longer than one-third of the height of the tower, as illustrated diagrammatically in FIGS. 38 and 39. To enable such structure and to enable the overlap of the successive tendons where they meet, structure like that shown in FIGS. 34 through 37 may be used. Here, there are slabs 270 which are substantially identical to the slabs 200** but which have a special shape of rib-splaying portion at one or more of their vertices,.

A rib 271 adjacent and to one side of the splay is especially constructed to provide an angularly-extending or curved passage 272 for one end of a tendon and a face 273 against which bears an anchor device 274 and against which a jack (not shown) can bear while tensioning a tendon 217.

Thus, at the area 226, the two tendons **217*a* and 217*b* or 215*a* and 215*b* or 235*a* and 235*b* cross. One end of the tendon 217*a* (for example) extends through one such rib 271, is anchored there by an anchor 274 and an end of the tendon 217*b* extends through the opposite rib 271 and is anchored there by another anchor 274**.

At the top of the tower, the upper ring 59 may be constucted, as shown in FIG. 40, from a series of slab members 280, each including a channel portion 281 having a bottom wall 282 and side walls 283 and also having a depending triangular slab portion 284, integral with the wall 282 and otherwise generally like the slab 202. The slab portion 284 has a vertical rib 285, through which a tendon 215 (or 235) extends, an anchor 286 therefor (or jack) being provided in the channel portion 281 atop the bottom wall 282. The slab portion 284 may have angularly-extending marginal ribs 287 and 288 secured by bolts 289 to adjacent slabs, such as a slab 290 generally like a slab 200 but with a splayed upper end rib 291. Tendons are applied as before. In addition, suitable tendons may be laid in the channel 281. Finally, with everything in place, suitably anchored and placed in tension, the channel 281 is filled with a suitable concrete.

The strength per volume of a tower of this invention:

Actual strengths are, of course, subject to design by the structural engineer and to actual calculations. But an example will illustrate some of the features of the invention.

For example, a slab of conventional shape—of uniform thickness—might be 20 feet by 20 feet by 9 inches thick, a volume of 300 cubic feet.

A slab of substantially the same area and same strength may be 20 feet by 20 feet by 3 inches for the skin, with edge ribs and cross ribs—like, for example, the slab 200. the edge ribs 204, 205, 206, and 207 may then be six inches wide by eighteen inches thick; the vertical rib 212 may have a cross section of four inches square, and the vertical rib 213 may have a cross section of 4 inches by 8 inches. Both these ribs would be about 28.3 feet long.

The concrete volume of such a slab 200 would be approximately the sum of:

| | | | |
|---|---|---|---|
| The skin | = 20 × 20 × 3/12 | = | 100.0 ft³ |
| Edge ribs | = 4/2 × 20 × 6/12 × 18/12 | = | 30.0 ft³ |
| Vertical rib | = 28.2 × 4/12 × 4/12 | = | 3.2 ft³ |
| Horizontal rib | = 28.3 × 8/12 × 4/12 | = | 6.5 ft³ |
| | Total | | 140.5 cu.ft. |

This means just about half as much concrete to achieve the same strength. At the same time, the post-stressing tendons would considerably reduce the amount of steel reinforcement needed. This would result in savings of about 50% to 60% so far as concrete and steel are concerned. This saving is to be added to the savings in construction time, of probably 50% or better. The complications in the waffle-like shape do not present a problem in view of the precasting and the re-use of forms. Apparently, construction of such a tower could run less than half the cost of a comparable prior art tower.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

We claim:

1. A cooling tower or the like, comprising:

a foundation having water collection means, a series of angularly-extending columns secured to said foundation and leading upwardly therefrom, a lower ring joining the upper ends of all said columns, a ribbed, waffle-like reinforced concrete wall extending up from said lower ring to provide a veil with a thin skin and ribs strengthening the structure and enabling the thickness of said skin to be relatively thin, said wall including a series of post-tensioning tendons, and an upper ring at the top of said wall, said wall being provided by:

a series of tiers of precast reinforced concrete panels, each panel having said ribs along edge portions thereof and defining a cavity where adjacent panels meet, some of said post-tensioning tendons being horizontally disposed at some of said tiers of panels, a series of upwardly-extending steel cages, one cage lying between each pair of adjacent penels of the same tier and enclosed by portions of said ribs, some of said post-tensioning tendons passing through said cages, and poured-in-place concrete filling the remainder of said cavities and said cages.

2. The tower of claim 1 wherein said panels are generally trapezoidal in shape.

3. The tower of claim 1 wherein said panels are predominantly generally diamond-shaped.

4. A cooling tower or the like, comprising:

a foundation having water collection means, a series of angularly-extending columns secured to said foundation and leading upwardly therefrom, a lower ring joining the upper ends of all said columns, a ribbed, waffle-like reinforced concrete wall extending up from said lower ring to provide a veil with a thin skin and ribs strengthening the structure and enabling the thickness of said skin to be relatively thin, said wall including a series of post-tensioning tendons, and an upper ring at the top of said wall, said columns being precast prestressed concrete columns having metal plates at both ends, said column also including piers secured to said foundation with an inclined upper surface on which one metal plate of each column bears, said lower ring including bearing members resting on the other metal plate of each said column.

5. The tower of claim 4 wherein said lower ring comprises:

a plurality of arcuate channel segments joined together to provide a closed-curve channel-shaped form, at least one post-tensioning tendon within said form, and concrete filling said channel and enclosing said tendon.

6. A hyperbolic paraboloid cooling tower or the like, comprising:

a foundation having a water-collecting pond, a series of angularly-extending columns secured to said foundation and leading upwardly and inwardly therefrom, said series describing a circle, a lower circular ring joining the upper ends of all said columns, a ribbed, waffle-like reinforced concrete wall extending up from said lower ring to provide a veil with a skin providing an inner surface shaped as a smooth hyperbolic paraboloid and an outer surface with ribs strengthening the wall and enabling the thickness of the skin in between the ribs to be relatively thin, said wall including a series of spaced-apart post-tensioning tendons, and a circular upper ring at the top of said wall, said wall comprising:

a series of tiers of precast panels, the panels in any one tier being substantially identical, each panel having one horizontal rib with a passage therethrough and one vertical rib with a passage therethrough and having marginal ribs along edges thereof, means for bolting adjacent panels together along said marginal edges, with said ribs and passages aligned, post-tensioning tendons extending through both said horizontal and vertical passages, and tensioning means for holding each tendon under tension, said lower ring comprising a series of circular-arc segments each shaped as a channel with a bottom wall and two generally vertical walls, the lowermost tier of said panels being secured to said bottom wall, post-tensioning tendons in said channel and under tension, and concrete filling said channel and securing said lowermost tier of panels to said lower ring.

7. The tower of claim 6 wherein:

said lowermost tier of panels are each triangular in shape with their bases secured to said bottom wall, each of the tiers above said lowermost tier, except an uppermost tier, comprising diamond-shaped panels, said uppermost tier of panels comprising triangular-shaped panels, said upper ring being secured to said uppermost tier of panels and comprising a series of circular-arc segment, each shaped as a channel with a bottom wall and two generally vertical walls, post-tensioning tendons in said channel and under tension, and poured-in-place concrete filling said channel.

8. A hyperbolic paraboloid cooling tower or the like, comprising:

a foundation having a water-collecting pond, a series of angularly-extending columns secured to said foundation and leading upwardly and inwardly therefrom, said series describing a circle, a lower circular ring joining the upper ends of all said columns, a ribbed, waffle-like reinforced concrete wall extending up from said lower ring to provide a veil with a skin providing an inner surface shaped as a smooth hyperbolic paraboloid and an outer surface with ribs strengthening the wall and enabling the thickness of the skin in between the ribs to be relatively thin, said wall including a series of spaced-apart post-tensioning tendons, and a circular upper ring at the top of said wall, said columns being prestressed concrete columns having metal plates at both ends, said foundation including upwardly-extending piers with an inwardly-inclined upper surface on which a lower said metal plate of each column bears, so that each said column is inclined inwardly, means for securing each said lower plate to a said pier, said lower ring including bearing members resting on an upper metal plate of each said column, and means for securing each said bearing member to said upper plate.

9. The tower of claim 8 wherein in addition to said columns that are inclined inwardly, there are outwardly-inclined precast columns having a lower metal plate on a lower end, piers on said foundation with upper, outwardly-inclined surfaces on which said lower metal plate bears, means for securing said lower metal plate to said piers, and means for joining an upper end of each said outwardly-inclined column to an upper portion of a said inwardly-inclined column for buttressing thereof.

10. The tower of claim 8 wherein said lower ring comprises:

a series of circularly-arcuate channel segments, each having a bottom wall and two upwardly-extending side walls to provide a channel, said segments being joined together to form a circle, at least one post-tensioning tendon within said channel, and concrete filling said channel and enclosing said tendon.

11. A hyperbolic paraboloid cooling tower or the like, comprising:

a foundation having a water-collecting pond, a series of angularly-extending columns secured to said foundation and leading upwardly and inwardly therefrom, said series describing a circle, a lower circular ring joining the upper ends of all said columns, a ribbed, waffle-like reinforced concrete wall extending up from said lower ring to provide a veil with a skin providing an inner surface shaped as a smooth hyperbolic paraboloid and an outer surface with ribs strengthening the wall and enabling the thickness of the skin in between the ribs to be relatively thin, said wall including a series of spaced-apart post-tensioning tendons, and a circular upper ring at the top of said wall, said wall being provided by:

a series of steel cages extending upwardly from said lower ring to said upper ring, a series of horizontal tiers of precast reinforced concrete panels, each panel having ribs along edge portions thereof, defining a cavity where adjacent panels meet, each said cavity fitting around and enclosing a said cage, each said panel being supported at two upwardly-extending edges by said cages, at least one said post-tensioning tendon for each tier, at least one said post-tensioning tendon inside each said steel cage, and poured-in-place concrete filling the remainder of said cavities and said cages.

* * * * *